United States Patent [19]

Fukumoto

[11] 4,299,348

[45] Nov. 10, 1981

[54] METHOD OF MAKING A GAME RACKET

[75] Inventor: Katsumi Fukumoto, Yokohama, Japan

[73] Assignee: Mansei Kogyo Kabushiki Kaisha, Saitama, Japan

[21] Appl. No.: 114,583

[22] Filed: Jan. 23, 1980

Related U.S. Application Data

[62] Division of Ser. No. 930,802, Aug. 3, 1978, abandoned.

[30] Foreign Application Priority Data

Aug. 26, 1977 [JP] Japan ..... 52/115151[U]

[51] Int. Cl.[3] ..... B21D 39/00; B23K 31/02

[52] U.S. Cl. ..... 228/144; 29/155 R; 72/178; 228/156; 228/158; 228/173 F; 273/73 C; 273/73 H

[58] Field of Search ..... 29/445, 155 R, 428; 72/178; 228/156, 155, 173 F, 144, 158; 273/73 C, 73 H

[56] References Cited

U.S. PATENT DOCUMENTS

| | | | |
|---|---|---|---|
| 1,779,185 | 10/1930 | Meiser et al. | 72/178 |
| 2,085,829 | 7/1937 | Rogers | 29/155 R |
| 3,164,896 | 1/1965 | Fullman | 228/156 X |
| 3,698,224 | 10/1972 | Saytes | 72/178 |
| 3,809,402 | 5/1974 | Haines et al. | 273/73 C |
| 3,899,172 | 8/1975 | Vaughn et al. | 273/73 C |

FOREIGN PATENT DOCUMENTS

| | | | |
|---|---|---|---|
| 2417439 | 10/1975 | Fed. Rep. of Germany | 273/73 H |
| 10948 | of 1894 | United Kingdom | 228/144 |
| 1099400 | 1/1968 | United Kingdom | 273/73 H |

*Primary Examiner*—Charlie T. Moon

*Attorney, Agent, or Firm*—Oblon, Fisher, Spivak, McClelland & Maier

[57] ABSTRACT

A game racket includes a generally oval head section and a handle section extending from the head section. A plastic brace is secured in the head section to complete the ovality of the head section. A hand grip is fixed to the handle section. The head section and the handle section are constituted by a tubular titanium strip which is provided with a Vickers hardness of 150 to 220.

6 Claims, 4 Drawing Figures

METHOD OF MAKING A GAME RACKET

This is a division of application Ser. No. 930,802, filed Aug. 3, 1978, now abandoned.

BACKGROUND OF THE INVENTION

This invention relates to rackets for tennis and like games, and more particularly to a metal racket frame which is constructed from a titanium material.

FIELD OF THE INVENTION

Hitherto, aluminium and chrome-molybdeum steel have been used as a basic structural material for manufacturing metal racket frames. These materials provide a better strength and are more easy to manufacture the racket frames when compared with the conventional wood or bamboo materials. However, the metal racket frames made from aluminium or chrome-molybdeum steel lack flexibility. As a result, at the moment of the impact of the metal racket on the ball, the racket momentally snaps the ball which disadvantageous leads to a lack of control of the shot in the play. Further, the aluminium racket frame, although providing satisfactory light-weight characteristics, has been criticized for breaking on high impact shots. The racket frame made from the chrome-molybdeum steel also has the same shortcomings. Namely, the chrome-molybdeum steel has a large specific gravity. Therefore, in order to provide a racket of chrome-molybdeum steel which has a total weight generally accepted in the sports, the thickness of its frame must be greatly reduced. As a result, the frame of this kind also often breaks on severe impact shots.

SUMMARY OF THE INVENTION

Accordingly, an object of the present invention is to provide an improved metal racket frame which posesses satisfactory strength and a desirable flexibility. In order to accomplish it, in the present invention, titanium material is used as the structural material for manufacturing the racket frame. Further, the finished tubular frame strip made from such titanium material is provided with a novel Vickers hardness in the range of 150 to 220 which hardness is suitable for such a racket frame having sufficient strength and flexibility. Such a value of the Vickers hardness of the present racket frame is obtained by means of a process of drawing a circular hollow tube which is shaped from a plate-like strip of the titanium material, because it is difficult to construct the racket frame by using a extrusion method in view of cost as well as of technique when using titanium. Further, using extrusion process, it is also difficult to make such racket frame which has the above indicated Vickers hardness. In the course of making the present racket frame, an annealing process may be done.

It is therefore one object of the present invention to provide an improved metal racket frame construction which overcomes the deficiencies of the conventional metal racket frame.

Another object of the present invention is to provide a novel metal racket frame which is constructed from a titanium material.

And another object of the present invention is to provide such a titanium metal racket frame which has a hardness necessary for the racket.

A further object of the present invention is to provide such a titanium metal racket frame which is relatively light in weight and possesses satisfactory strength, flexibility and durability.

BRIEF DESCRIPTION OF THE DRAWINGS

Other objects of the attendant advantages of the present invention will be readily appreciated as the same becomes better understood by reference to the following detailed description when considered in connection with the accompanying drawings, in which like reference characters designate the same or similar parts throughout the figures thereof and wherein:

FIG. 3 (II) is a modification of FIG. 3 (I); and

DETAILED DESCRIPTION OF THE PREFERRED EMBODIMENT

Figure 2:
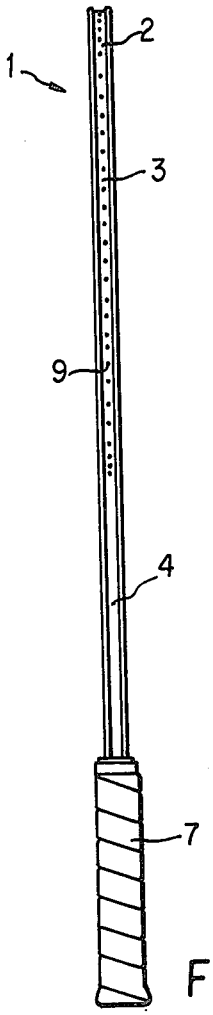
FIG. 2 is a side view of the racket as shown in FIG. 1.
Figure 1:
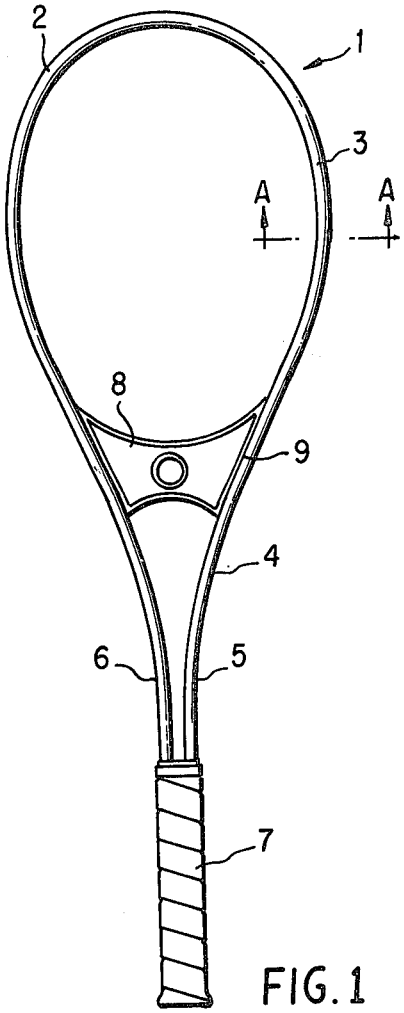
FIG. 1 is an elevational view of a racket according to the present invention.

Referring now to the drawings in detail, wherein like numerals indicate like elements, there is shown in FIGS. 1 and 2 a tennis racket in accordance with the preferred embodiment of the present invention designated generally as (1). The racket (1) includes a racket frame comprising a frame strip (2) which is bent to form a generally oval head section (3) and a handle section (4) defined by opposed end sections (5;6) of the frame strip (2) in parallel spaced relationship. A hand grip (7) is fixed to the lower extremities of the end sections (5;6). A plastic brace (8) seats in and is secured in a brace section (9) of the oval head section (3) of the frame strip (2) to define the generally oval impact area of the racket (1). The frame strip (2) is constructed from a titanium material whose method of manufacturing will be explained below.

Titanium can be processed through either the extrusion or drawing method. In order to provide an economical or less costly method of the titanium racket production, the drawing method is adopted by which a plate-like strip is translated into a particular tubular form as described hereinafter.

Figure 3I:
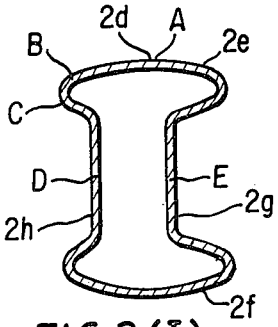
FIG. 3 (I) is a sectional view taken substantially along the lines A—A of FIG. 1.
Figure 3:
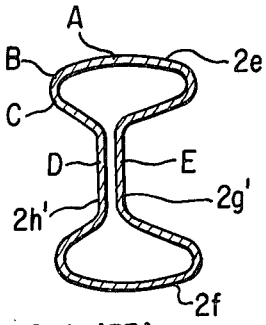
Figure 4A:
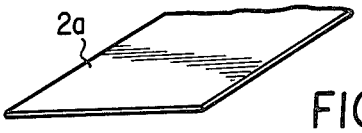
FIG. 4 is a schematic presentation of the steps of manufacturing a racket frame according to the method of the present invention.
Figure 4B:
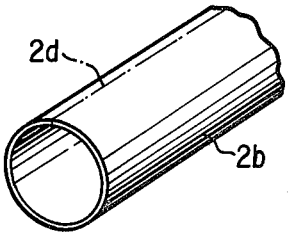
Figure 4C:
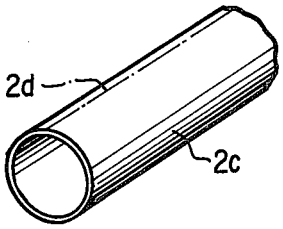
Figure 4D:
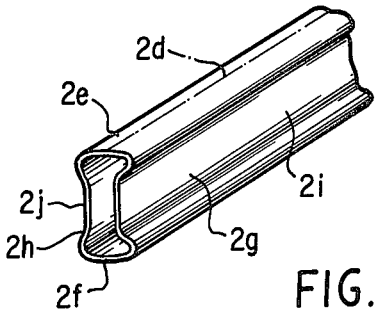

Referring now to FIG. 4, reference numeral (2*a*) is a plate-like strip of titanium. This strip has a thickness of 0.7 mm and a weight of about 260 g. The thickness and weight of the strip are selected in consideration of the overall weight of a finished tennis racket which is controlled within a certain range. The strip (2*a*) is, after being annealed, bent into a tubular form to shape a first circular hollow tube (2*b*) with its opposed edges being welded closed. The resultant tube (2*b*) is annealed again to make the ensuing process of drawing easier. The same tube (2*b*) is then drawn to form a second circular hollow tube (2*c*). At this stage of drawing work, the diameter of the tube is reduced from 19° to 16.8° and the welded portion (2*d*) is reinforced to bear the further processes. The second hollow tube (2*c*) is further drawn into the bone-shaped tubular frame strip (2) whose cross sections is shown in FIGS. 3 (I) (II) and 4. The strip (2) comprises upper and lower arc sections (2*e*;2*f*) interconnected by opposed web sections (2*g*;2*h*). Both web sections (2*g*;2*h*) are depressed and shaped to provide a groove (2*i*;2*j*) together with the adjacent arc sections (2*e*;2*f*). In this groove (2*i*;2*j*) there are formed in a conventional manner a plurality of string holes for stringing (not shown) by drilling or similar method.

In FIG. 3, there are shown two different cross sections of the tubular frame (I) and (II). The tubular frame of the first cross section (I) has a relatively large spacing between the opposed web sections (*2g;2h*). On the contrary, the second cross section (II) shows a tubular frame whose spacing between the opposed web sections (*2g';2h'*) is narrowed. This construction makes it possible to form the string holes by press work which is the most convenient and simplest way among various possible methods. The spacing suitable for the press work is not more than 1 mm. In view of avoiding the reduction of frame strength, however, it is preferred to provide a spacing of about 1 mm between the web sections (*2g';2h'*). The frame strip (2) is bent into ovality as shown in FIG. 1. In the course of this processing, the welded portion (*2d*) is most liable to crack or break due to two different kinds of force, i.e. tension and compression applied thereat. Such a crack or break can be avoided by arranging the welded portion (*2d*) on the part of the upper or lower arc sections (*2e;2f*) of the frame strip (2). Preferably, such welded portion (*2d*) is designed to be located at the longitudinal center-line of one of the arc sections (*2e;2f*) of the frame strip (2), because the center-line of each arc section (*2e;2f*) of the frame strip (2) is least affected by both tensional and compressional force when the frame strip (2) is bent into the oval shape. Namely, at this portion, both tensional and compressional force approach zero. Further, after the frame strip (2) is bent into the oval shape, its surface is polished by means of a sandblast. Accordingly, the surface of the frame strip (2) becomes hard and is protected from mar.

In order to construct an improved racket frame which is provided with a satisfactory strength as well as a desirable flexibility, it is an important element that the finished frame strip has an adequete hardness. For this purpose, the hardness of the frame strip is indicated by Vickers hardness (Hv) which is taken by an average of the hardness of some different portions on the finished frame strip. In this specification, five different portions (A,B,C,D,E) of the frame strip (2) are measured (as shown in FIG. 3) to ascertain the suitable Vickers hardness. According to our test, when the value of the Hv is less than 150, the frame strip (2) becomes too soft. As a result, even if load is removed from the frame strip (2), the frame strip (2) remains strained and premanently deformed. On the contrary, in case that the value when the Vickers hardness is more than 220, the frame strip (2) becomes too hard. As a result, the frame strip (2) often breaks, particularly at the welding portion (*2d*) thereof. In this way, the frame strip (2) whose value of the Vickers hardness is less than 150 or is more than 220 is found to be unsuitable for manufacturing a racket frame that posesses superior strength and flexibility. In view of the above-mentioned fact, the titanium strip (*2a*) used for the illustrated embodiment is provided with 140 in its Vickers hardness. Then, the Vickers hardness is gradually enhanced in the course of processing as explained above. The value of 180 is the most suitable Vickers hardness by which both flexibility and strength required for a tennis racket are satisfied. In this specification, the invention has been described in relation to the tennis racket, but the same idea of the processing and the Vickers hardness can be used for other game rackets. For example, a badminton racket frame having such Vickers hardness produces high performance for the same reasons.

Obviously, many modifications and variations of the present invention are possible in light of the above teachings. It is therefore to be understood that within the scope of the appended claims, the invention may be practices otherwise than as specifically described herein.

What we claimed is:

1. A method of making a frame strip for a game racket having a generally oval head, a throat, a handle portion and a grip at the end of said handle portion, comprising the steps of:

forming a first circular hollow tube by welding together the opposed edges of a plate-like strip of titanium material;

drawing said first circular hollow tube to form a second circular hollow tube of reduced diameter;

further drawing said second circular hollow tube into a bone-shaped frame strip with a pair of arcuate sections connected by spaced web sections, in such a manner as said weld lies longitudinally on and along one of said arcuate sections;

providing said frame strip with a vickers hardness in the range of 150 to 220; and bending said frame strip into an oval shape to form said generally oval head of the racket.

2. The method of claim 1 in which said weld is arranged to extend on and along the longitudinal center-line of one of said arcuate sections.

3. The method of claim 1 in which said first circular hollow tube is annealed before being drawn to form said second circular hollow tube.

4. The method of claim 1 in which said second circular hollow tube is drawn to form said bone-shaped frame strip which is provided with a spacing, said spacing being less than 1 mm between said web sections.

5. The method of claim 1 in which said first welded circular hollow tube is made from said plate-like titanium material having a weight of about 260 G and a thickness of 0.6 mm, and wherein said first welded circular hollow tube is translated into said bone-shaped frame strip by means of said drawing process.

6. The method of claim 1 in which after said bone-shaped frame strip has been bent to form said generally oval head of the racket, the surface of said frame strip is finished by means of a sandblast treatment.

* * * * *